US005922432A

United States Patent [19]

Kalal

[11] Patent Number: 5,922,432

[45] Date of Patent: Jul. 13, 1999

[54] CORNER MEMBER FOR REINFORCING TARPAULINS

[75] Inventor: John David Kalal, Akron, Ohio

[73] Assignee: Schott International, Inc., Akron, Ohio

[21] Appl. No.: 09/059,024

[22] Filed: Apr. 13, 1998

[51] Int. Cl.[6] ..... B32B 3/10

[52] U.S. Cl. ..... 428/80; 428/99; 428/131; 428/137

[58] Field of Search ..... 428/99, 137, 131, 428/80; 135/119; 114/103

[56] References Cited

U.S. PATENT DOCUMENTS

| | | | |
|---|---|---|---|
| 4,777,071 | 10/1988 | Liu | 428/120 |
| 5,415,915 | 5/1995 | Oh | 428/99 |
| 5,424,107 | 6/1995 | Lee | 428/80 |

*Primary Examiner*—Alexander Thomas
*Attorney, Agent, or Firm*—Renner, Kenner, Greive, Bobak, Taylor & Weber

[57] ABSTRACT

A corner reinforcement for tarpaulins has an upper and lower plate connected by two enclosed edges forming a right angle. The reinforcement structure has an open edge that arcs back towards the corner defined by the enclosed edges and has rivet holes fixed along an arc concentric thereto. A rib positioned on the inside surface of the top plate runs along the arc defined by the rivet holes on the upper plate, while a mateable groove positioned on the inside surface of the bottom plate runs along the arc defined by the rivet holes on the bottom plate. A grommet is also provided for securing a rope to the corner of the tarpaulin. The corner of a tarpaulin is inserted through the open edge and its shape is accommodated by the right angle formed by the enclosed edges. The rivets are then fixed in place causing the rib and groove to mate, providing reinforcement to the corner.

6 Claims, 2 Drawing Sheets

CORNER MEMBER FOR REINFORCING TARPAULINS

TECHNICAL FIELD

The present invention generally relates to a reinforcement for cloth. More particularly, the invention relates to a corner reinforcement for cloth, such as a tarpaulin, serving to protect a comer of the tarpaulin from the forces acting upon it when the tarpaulin is pulled taut and secured by a rope attached to the corner.

BACKGROUND ART

Tarpaulins are commonly used to provide weatherproof cover over a particular area or mass of material. Many times, tarpaulins are used in conjunction with poles and ropes to create basic tent-like structures, providing protection from wind and rain. In the construction of such a structure, the tarpaulin must be stretched and secured across the poles to avoid the collapse of the structure and assure that the tent will not be overly affected by the wind. Tarpaulins may also be used to cover and protect materials during transportation in truck beds or to protect materials that are stored outside. In such instances, the tarpaulin is placed over the material and pulled taut by ropes connected to the corners of the tarpaulin. These ropes may be secured to a vehicle or storage structure. For example, an open end truck bed may be filled with material to be transported and subsequently covered by a tarpaulin secured by a rope or cable in order to protect it from the elements. The waterproof property of the tarpaulin will provide protection from rain and snow and, by pulling the tarpaulin taut, the large wind forces encountered during transportation will not be able to blow back the tarpaulin and expose the truck's load to the elements.

To assist in the securing of such covers, the corners of the cover material are folded over and stitched for reinforcement and are provided with an annular opening through which a grommet is fixed so that a rope or other securing means may be inserted therethrough and tied at a support. However, forces acting upon the grommet often cause the material to become raveled or stretched and, as a consequence, the grommet eventually breaks loose.

The prior art has addressed this problem by providing triangular and trapezoidal shaped comer reinforcement structures having upper and lower plates enclosed at two sides and open at the other sides thereof, thereby allowing for a tarpaulin or canvas cover to be inserted therethrough. These structures are also fixed with an annular opening for the placement of a grommet through which a rope or the like may be inserted. The corner reinforcement structures of the prior art are also constructed with rivet holes that provide a means for fastening the upper and lower plates to the corner of the material. Finally, the prior art has provided the upper and lower plates with a plurality of mating ribs and grooves that serve to interlock and pinch the corner material when the two plates are riveted together. Such prior art is generally exemplified by U.S. Pat. Nos. 4,777,071, 5,415,915 and 5,424,107.

The prior art, however, does not optimize the reinforcement of the corner inasmuch as the rivet holes, ribs and grooves of the reinforcement structures are not positioned in a manner that efficiently distributes the forces impacting the corner of the material. The prior art teaches a placement of the ribs and grooves to which the forces impacting the corner of the material are substantially parallel, creating a situation in which the ribs and grooves provide some, but far from optimal, reinforcement. Moreover, rivets secured through rivet holes as positioned in the prior art serve merely to clamp the corner reinforcement to the corner of the material and do little to optimize the reinforcement thereof.

There is a need in the art for a substantial improvement by utilizing both the placement of the rivet holes and the shape and placement of the ribs and grooves to optimize the reinforcement of the corner of the material.

DISCLOSURE OF INVENTION

It is therefore an object of the present invention to provide a corner reinforcement for a tarpaulin that allows for easy insertion of and attachment to a tarpaulin or like material.

It is a further object of the present invention to provide a corner reinforcement for a tarpaulin utilizing a grommet for protection thereof from stress encountered when a rope or cord tied at the grommet pulls the tarpaulin taut and is secured to a support.

It is another object of the present invention to provide a means for securing the corner reinforcement to a tarpaulin corner, wherein such means serves to evenly distribute the forces encountered by the corner, thereby optimizing the enforcement of the corner and preventing the rapid wear of the tarpaulin area surrounding the grommet and, consequently, increasing the life of the tarpaulin.

The foregoing and other aspects of the invention which will become apparent as the detailed description proceeds are achieved by a corner reinforcement for a tarpaulin comprising: a top plate; a bottom plate; an enclosed edge connecting said top plate and said bottom plate along two sides and meeting in a right angle; an arcuate mouth, positioned opposite said enclosed edge, said arcuate mouth extending in a concave shape towards the corner of said enclosed edge, said arcuate mouth being defined by the space between said top and bottom plates; at least one arcuate rib positioned on an inner surface of said top plate and substantially concentric with said arcuate mouth; at least one arcuate groove positioned on an inner surface of said bottom plate and in registration with said arcuate rib; a clamping means capable of bringing said top plate and said bottom plate into contact with one another, thereby mating said arcuate rib with said arcuate groove; and a grommet set inboard from the corner of said enclosed edge.

Other aspects of the invention which will become apparent herein are achieved by a corner reinforcement for a tarpaulin, comprising: a top plate; a bottom plate; an enclosed semicircular edge connecting said top plate and said bottom plate along two sides and meeting in a right angle; an arcuate mouth, positioned opposite said enclosed semicircular edge, said arcuate mouth extending in a concave shape towards the corner of said enclosed semicircular edge, said arcuate mouth being defined by a space between said top and bottom plates; a plurality of rivet holes in said top plate and said bottom plate, said plurality of rivet holes being positioned substantially concentric with said arcuate mouth and juxtaposed to receive rivets secured through said top and bottom plates; and a grommet set inboard from the comer of said enclosed semicircular edge.

BRIEF DESCRIPTION OF THE DRAWINGS

For a complete understanding of the objects, techniques, and structure of the invention, reference should be made to the following detailed description and accompanying drawings wherein.

BEST MODE FOR CARRYING OUT THE INVENTION

Figure 1:
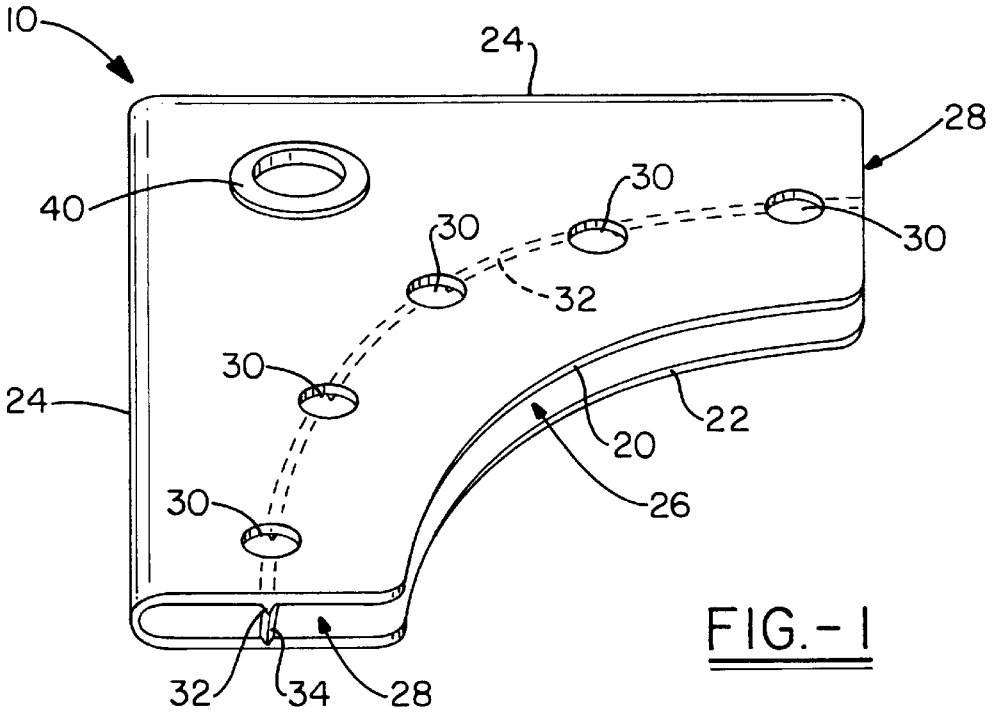
FIG. 1 is a perspective view of the preferred embodiment of the corner reinforcement of the present invention.

Referring now to the drawings and more particularly to FIG. 1, it can be seen that the corner reinforcement of the present invention is designated generally by the numeral 10. The corner reinforcement 10 has a top plate 20 running parallel to bottom plate 22. The top plate 20 and bottom plate 22 are separated by a predetermined distance and are connected by the enclosed right angle edge 24. The enclosed right angle edge 24 is formed by the intersection of two enclosed edges of semicircular cross section such that the comer reinforcement 10 is a single piece or integral unit that is capable of fully receiving the corner of the tarpaulin and which provides maximum protection thereof. In the preferred embodiment of the invention, the single piece unit is formed of plastic, although it should be appreciated that the present invention is not limited thereto and other appropriate materials may be employed.

Opposite the enclosed right angle edge 24, the top plate 20 and bottom plate 22 provide an open arcuate mouth 26. The open arcuate mouth 26 is offset from the enclosed right angle edge 24 by open edges 28 that extend perpendicularly from the enclosed right angle edge 24. The open arcuate mouth 26, together with the open edges 28, provide an arcuate insertion area that facilitates the placement of the corner reinforcement 10 over an associated corner of a tarpaulin. Also, by offsetting the open arcuate mouth 26, the open edges 28 provide room for the placement of the rivet holes 30.

The rivet holes 30 are positioned along an arc concentric with the open arcuate mouth 26 and provide a means for securely attaching the corner reinforcement 10 to the corner of the tarpaulin. To further reinforce the attachment of the corner reinforcement 10 to the tarpaulin, an arcuate rib 32, having a triangular cross section, and an arcuate groove 34, having a triangular cross section capable of mating with the arcuate rib 32, are positioned along the arc defined by the rivet holes 30. The arcuate rib 32 is positioned on the inner surface of the top plate 20 and the arcuate groove 34 is positioned on the inner surface of the bottom plate 22 so that the closure of the plates 20, 22 by the fixing of rivets in the holes 30 causes the arcuate rib 32 to extend into the arcuate groove 34, thereby pinching the tarpaulin therebetween and further reinforcing and protecting the corner. In other words, the rib 32 and groove 34 define a bite, effected by the riveting operation, which secures and maintains the tarpaulin corner. While the preferred embodiment of the present invention suggests that the rib 32 and groove 34 have cross sections of triangular shape, it should be appreciated that other mateable shapes may be used to effect the desired bite. Similarly, the number and spacing of the rivets may also vary as a function of application.

Figure 2:
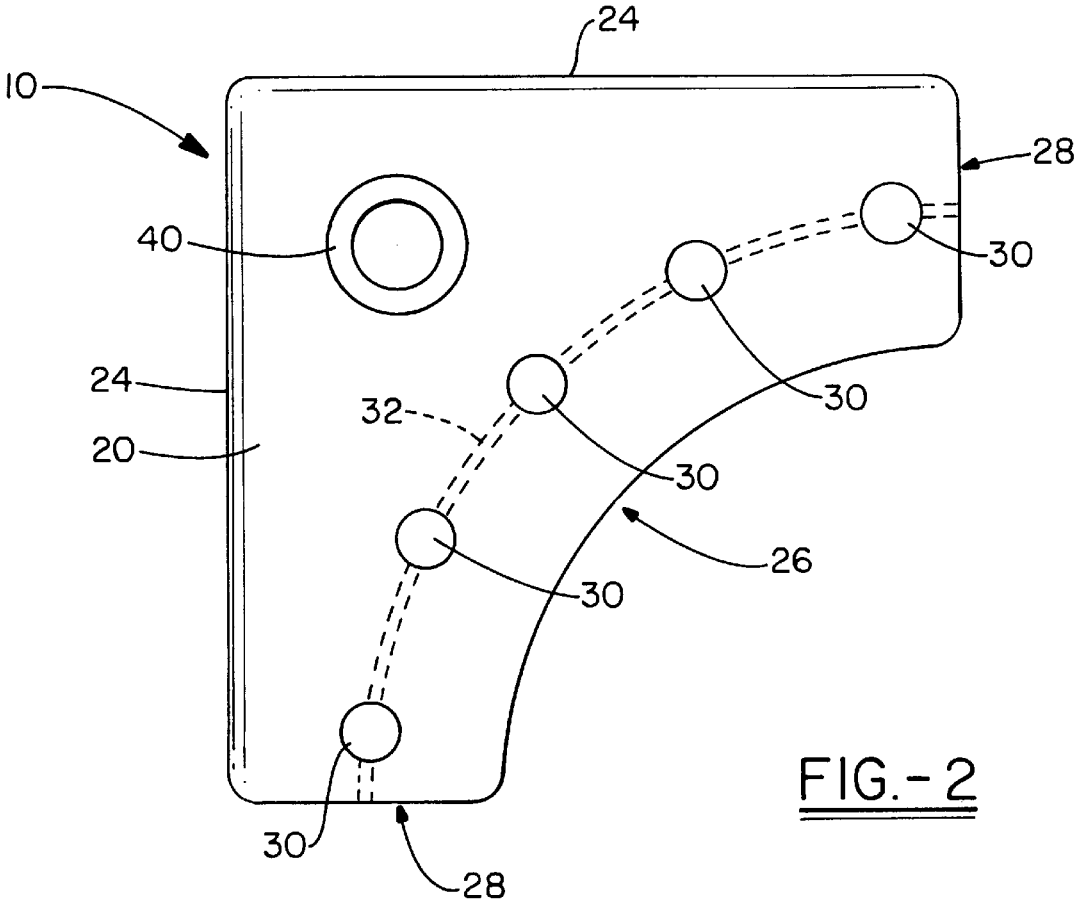
FIG. 2 is a top plan view of the preferred embodiment of the present invention.
Figure 3:
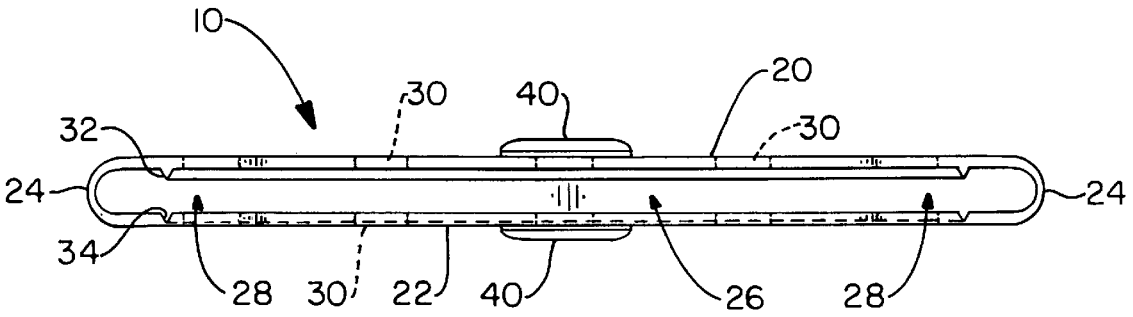
FIG. 3 is an elevational view as may be taken along a line looking into the opening of the reinforcement member toward the closed corner thereof.
Figure 4:
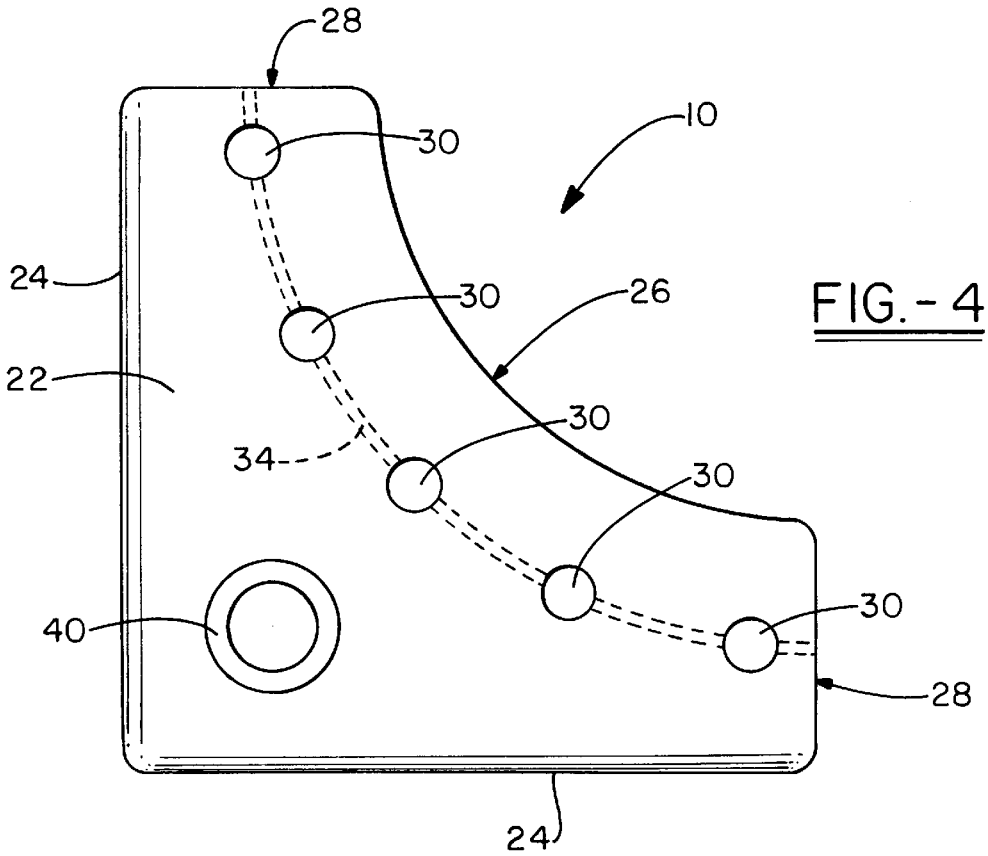
FIG. 4 is a bottom plan view of the preferred embodiment of the present invention.

Referring now to FIGS. 2–4, it can be seen that a grommet 40 is set inboard from the corner of the enclosed right angle edge 24 and the rivet holes 30. In the preferred embodiment, the grommet 40 is positioned inboard from the corner so that the center of the grommet 40 lies upon a line bisecting the ninety degree angle created by the enclosed right angle edge 24. Such a positioning is preferred because the rope securing the corner is typically pulled taut within forty-five degrees to either side of this bisecting line and optimal reinforcement is appreciated because the pulling force from the rope is then contained within a ninety degree sector. The grommet 40, extending through the top plate 20 and bottom plate 22, provides a securing means for the tarpaulin and may be made of any material commonly used in the art. The grommet 40 may be a traditional grommet of brass or the like, or it may simply comprise an enlarged annular collar extending from and integral with the top and bottom plates 20, 22.

As discussed hereinabove, the corner of a tarpaulin is inserted into the corner reinforcement 10 and positioned so that the corner of the tarpaulin makes continuous contacting engagement with the enclosed right angle edge 24. The corner reinforcement 10 is then fixedly attached to the corner of the tarpaulin by securely fastening the grommet 40 in place and securing rivets through the rivet holes 30, urging the plates 20, 22 toward each other and creating a bite between rib 32 and groove 34. When a rope attached to the grommet 40 is pulled taut and bound to a support structure, the corner reinforcement 10 protects and reinforces the corner of the tarpaulin by distributing the forces acting upon the corner between the grommet 40, the arcuate rib 32, the arcuate groove 34, and the rivets attached through the rivet holes 30, thereby lessening the stress and significantly reducing the wear and tear on the portion of the tarpaulin immediately surrounding the grommet 40. As a result, there are significantly fewer occurrences of the grommet 40 breaking loose from the tarpaulin. The arcuate positioning of the rivets, arcuate rib 32, and arcuate groove 34, optimizes the reinforcement of the corner since the forces impacting the corner are typically normal to the arc defined by the rivets, arcuate rib 32 and arcuate groove 34.

Thus it can be seen that the objects of the invention have been satisfied by the structure presented above. While a preferred embodiment of the invention has been presented and described in detail, it will be understood that the invention is not limited thereto or thereby. As such, various configurations may be used in the construction and operation of the invention to meet the various needs of the consumer. Accordingly, for an appreciation of the true scope and breadth of the invention, reference should be made to the following claims.

What is claimed is:

1. A corner reinforcement for a tarpaulin comprising:

a top plate;

a bottom plate;

an enclosed edge connecting said top plate and said bottom plate along two sides and meeting in a right angle;

an arcuate mouth, positioned opposite said enclosed edge, said arcuate mouth extending in a concave shape towards the corner of said enclosed edge, said arcuate mouth being defined by the space between said top and bottom plates;

at least one arcuate rib positioned on an inner surface of said top plate and substantially concentric with said arcuate mouth;

at least one arcuate groove positioned on an inner surface of said bottom plate and in registration with said arcuate rib;

a clamping means capable of bringing said top plate and said bottom plate into contact with one another, thereby mating said arcuate rib with said arcuate groove; and a grommet set inboard from the corner of said enclosed edge.

2. The corner reinforcement tarpaulin according to claim 1 wherein said clamping means comprise apertures for the placement and clamping of rivets.

3. A corner reinforcement for a tarpaulin, comprising:

a top plate;

a bottom plate;

an enclosed semicircular edge connecting said top plate and said bottom plate along two sides and meeting in a right angle;

an arcuate mouth, positioned opposite said enclosed semicircular edge, said arcuate mouth extending in a concave shape towards the corner of said enclosed semicircular edge, said arcuate mouth being defined by a space between said top and bottom plates;

a plurality of rivet holes in said top plate and said bottom plate, said plurality of rivet holes being positioned substantially concentric with said arcuate mouth and juxtaposed to receive rivets secured through said top and bottom plates; and a grommet set inboard from the corner of said enclosed semicircular edge.

4. The corner reinforcement for a tarpaulin according to claim 3, further comprising:

at least one rib positioned on an inner surface of said top plate; and at least one groove positioned on an inner surface of said bottom plate, wherein each groove so provided is in registration with a corresponding rib.

5. The corner reinforcement for a tarpaulin according to claim 3, further comprising:

at least one arcuate rib positioned on an inner surface of said top plate and concentric with said arcuate mouth; and at least one arcuate groove positioned on an inner surface of said bottom plate, wherein each groove so provided is in registration with a corresponding rib.

6. The corner reinforcement for a tarpaulin according to claim 3, further comprising:

an arcuate rib extending along an arc defined by the rivet holes and positioned on an inner surface of said top plate; and an arcuate groove extending along an arc defined by the rivet holes, and positioned on an inner surface of said bottom plate, said rib and said groove being in registration with each other.

* * * * *